US007695303B2

(12) United States Patent
Chen et al.

(10) Patent No.: US 7,695,303 B2
(45) Date of Patent: Apr. 13, 2010

(54) APPARATUS FOR PLUG-IN AND PLUG-OUT PROTECTION

(75) Inventors: Oscar Chen, ShangHai (CN); Scott Nagel, Trumbull, CT (US); Randy J. Below, Cheshire, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 12/263,546

(22) Filed: Nov. 3, 2008

(65) Prior Publication Data

US 2009/0124138 A1 May 14, 2009

Related U.S. Application Data

(60) Provisional application No. 60/984,790, filed on Nov. 2, 2007.

(51) Int. Cl.
*H01R 13/627* (2006.01)

(52) U.S. Cl. ..... 439/352; 439/344

(58) Field of Classification Search ..... 439/352, 439/344, 354, 676

See application file for complete search history.

(56) References Cited

U.S. PATENT DOCUMENTS

| | | | | |
|---|---|---|---|---|
| 4,155,159 | A | 5/1979 | Hogan et al. | |
| 4,893,488 | A | 1/1990 | Klein | |
| 6,994,580 | B1 * | 2/2006 | Chen | 439/344 |
| 7,182,621 | B2 | 2/2007 | Reichle | |
| 7,204,721 | B2 | 4/2007 | Lundholm et al. | |
| 7,249,979 | B2 | 7/2007 | Gerber et al. | |
| 7,329,137 | B2 | 2/2008 | Martin et al. | |
| 7,354,291 | B2 | 4/2008 | Caveney et al. | |
| 7,399,195 | B2 * | 7/2008 | Kim et al. | 439/352 |
| 7,438,584 | B2 * | 10/2008 | Caveney et al. | 439/344 |
| 2002/0031944 | A1 * | 3/2002 | Endo | 439/595 |
| 2006/0040564 | A1 | 2/2006 | Morrison et al. | |
| 2006/0089039 | A1 * | 4/2006 | Caveney et al. | 439/352 |
| 2006/0134963 | A1 | 6/2006 | Lo et al. | |
| 2007/0049076 | A1 | 3/2007 | Yamada et al. | |
| 2007/0232115 | A1 | 10/2007 | Burke et al. | |

FOREIGN PATENT DOCUMENTS

WO 2007016794 2/2007

OTHER PUBLICATIONS

International Search Report, PCT/US08/82180, Jan. 6, 2009.

* cited by examiner

*Primary Examiner*—Hien Vu
(74) *Attorney, Agent, or Firm*—Cantor Colburn LLP

(57) ABSTRACT

A telecommunications plug comprising: a plug body; plug latches mounted on the plug body, the plug latches being movable between a latched and unlatched state; a boot cap having arms extending therefrom, each arm including a camming surface engaging an outside surface of the plug latches, wherein moving the boot cap in a first direction drives the latches towards each other; a cap latch mounted to the boot cap, the cap latch having a distal end positioned between the latches preventing movement of the boot cap in the first direction; the boot cap including an opening for receiving a key to deflect the cap latch allowing movement of the boot cap in the first direction.

3 Claims, 5 Drawing Sheets

APPARATUS FOR PLUG-IN AND PLUG-OUT PROTECTION

CROSS-REFERENCE TO RELATED APPLICATIONS

This application claims the benefit under 35 U.S.C. §119 (e) of U.S. Provisional Patent application 60/984,790, filed Nov. 2, 2007, the entire contents of which are incorporated herein by reference.

BACKGROUND

In telecommunications applications, plugs and outlets mate to establish connections for voice, data, etc. There are situations where it is desirable to control the ability for an individual to mate a plug and outlet (i.e., plug-in) or to disconnect a plug-outlet connection (i.e., plug-out). For example, an outlet may provide access to a network to which access needs to be controlled. Thus, there exist in the art lockable covers to prevent inadvertent or deliberate attempts to access the outlet. Additionally, a mated plug and outlet may be carrying voice/data traffic and interruption of this connection would disrupt the signal path. Thus, there exist in the art plugs having locking mechanisms to prevent inadvertent or deliberate removal of a plug from an outlet. There is a need in the art for improved plug-in and plug-out protection.

SUMMARY

Embodiments of the invention include a telecommunications plug comprising: a plug body; plug latches mounted on the plug body, the plug latches being movable between a latched and unlatched state; a boot cap having arms extending therefrom, each arm including a camming surface engaging an outside surface of the plug latches, wherein moving the boot cap in a first direction drives the latches towards each other; a cap latch mounted to the boot cap, the cap latch having a distal end positioned between the latches preventing movement of the boot cap in the first direction; the boot cap including an opening for receiving a key to deflect the cap latch allowing movement of the boot cap in the first direction.

Other embodiments include a telecommunications outlet locking apparatus comprising: an outlet cap having a front face that covers an opening to a telecommunications outlet; a body portion coupled to the front face, the body portion sized to fit in the interior of the telecommunications outlet; a resilient latch supported by the body portion, the latch positioned behind a front wall of the telecommunications outlet preventing removal of the cap; an opening formed through the outlet cap; a key sized and shaped to fit through the opening formed through the outlet cap, enter the telecommunications outlet and disengage the latch.

DETAILED DESCRIPTION

Figure 1:
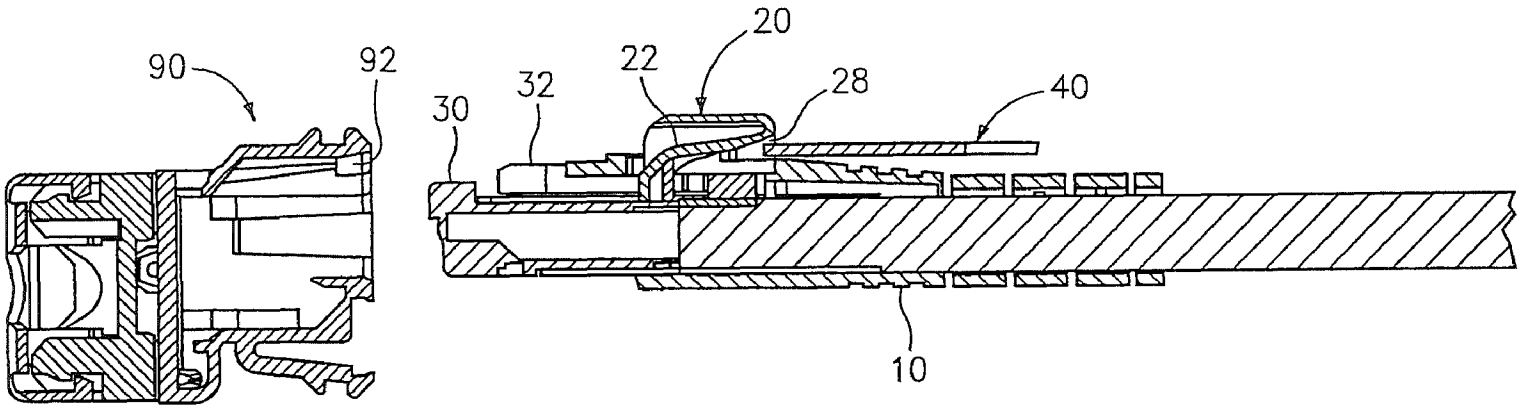
FIG. 1 is a cross-sectional view of a plug in embodiments of the invention.

FIG. 1 is a cross-sectional view of a plug in embodiments of the invention. The plug includes a plug body 30 having latches 32. The plug body 30 and latches 32 are similar to that shown in U.S. Pat. Nos. 6,863,556, 7,037,129, 7,163,414, the entire contents of each patent are incorporated herein by reference. The plug body 30 engages an outlet 90 by latches 32 catching the back of outlet projections 92 of as known in the art.

A boot cap 20 is positioned on the plug body 30 and includes a cap latch 22 for preventing plug-out of the plug, as described in further detail herein. The boot cap 20 and the plug boot 10 slide as a unit backwards and forwards relative to the plug body 30 to latch or unlatch latches 32. A plug key 40 is used to disengage the cap latch 22 and allow the plug latches 32 to be released from an outlet as described in further detail herein. With cap latch 22 released, plug boot 10 and boot cap 20 can slide backwards from plug body 30 to disengage latches 32 as described in U.S. Pat. Nos. 6,863,556, 7,037,129, 7,163,414.

Figure 2:
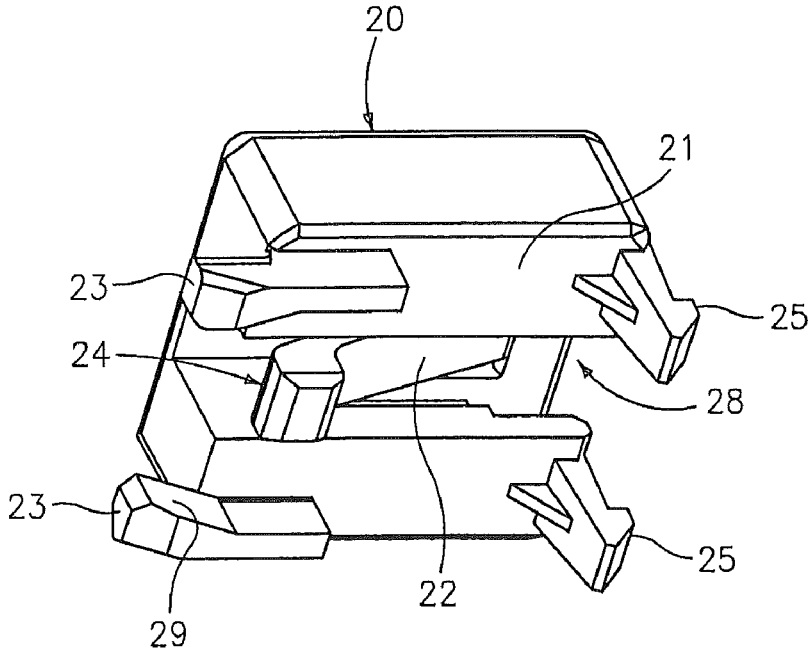
FIG. 2 is a perspective view of a boot cap in embodiments of the invention.
Figure 5:
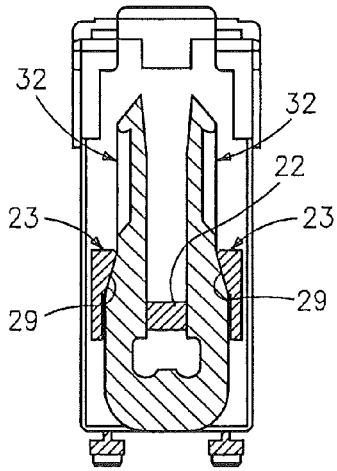
FIG. 5 is a top, cross-sectional view of a plug body and boot cap in embodiments of the invention.

FIG. 2 is a perspective view of boot cap 20 in embodiments of the invention. Boot cap 20 includes a resilient cap latch 22 having a distal end 24 that is received between latches 32 on the plug body 30. Boot cap 20 includes a generally rectangular base 21 having arms 23 and mounting latches 25 extending therefrom. Arms 23 including camming surfaces 25 that ride along an outside surface of each latch 32 (FIG. 5). As the boot cap 20 is moved backwards away from the nose of plug body 30, the camming surface 29 drive the latches 32 towards each other to disengage the plug from an outlet.

Mounting latches 25 engage openings in boot 10 to secure the boot cap 20 to boot 10. As described in U.S. Pat. Nos. 6,863,556, 7,037,129, 7,163,414, boot 10 slides relative to plug body 30. Arms 23 on the boot cap engage plug latches 32 to push the latch arms towards each other when the boot 10 is pulled back away from the plug body 30 and outlet. This disengages the latch arms 32 from an outlet. As described in U.S. Pat. Nos. 6,863,556, 7,037,129, 7,163,414, when boot 10 is pushed towards plug body 30 and the outlet, the latch arms 32 return to a rest position and engage the outlet in a latched state to secure the plug to the outlet. If cap latch 22 is not defeated with key 40, the distal end 24 of cap latch 22 is wedged between the inside surfaces of latches 32 to prevent travel of the plug boot 10 and the boot cap 20. The cap latch 22, when not defeated, prevents the boot cap 20 and boot 10 from moving backwards thus preventing delatching of the plug from an outlet.

Figure 3:
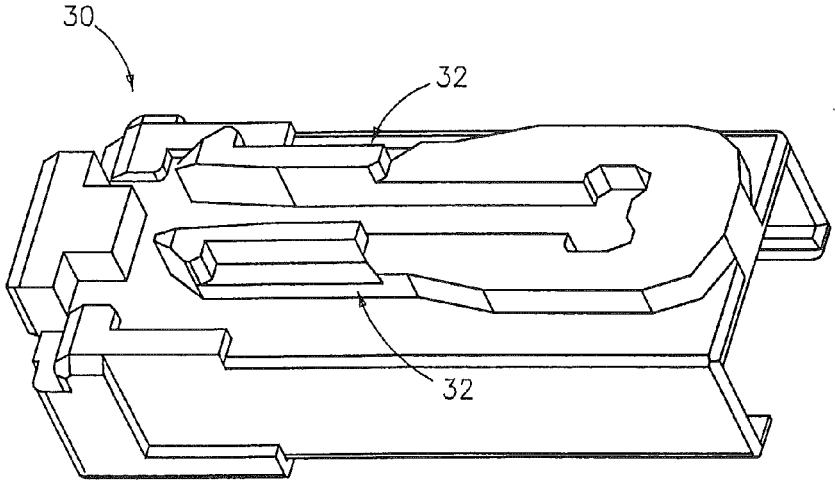
FIG. 3 is a perspective view of a plug body in embodiments of the invention.

FIG. 3 is a perspective view of a plug body in embodiments of the invention. As shown in FIG. 3, the plug body 30 includes latches 32. As described in U.S. Pat. Nos. 6,863,556, 7,037,129, 7,163,414, when the latches 32 flex towards each other, this allows the plug to be removed from an outlet. Sliding of boot cap 20 and boot 10 backwards away from the plug body 30 and the outlet causes the latches 23 to flex towards each other by virtue of camming surfaces 29 driving the latches 32. Moving the boot cap 20 and the boot 10 forward towards the nose of plug body 30 and the outlet moves the camming surfaces 29 forward, allowing the latches 32 to move apart from each other to their rest state. When the latches 32 are moved apart from each other (i.e., in their rest position), the latch distal ends engage the outlet to secure the plug body 30 to the outlet.

Figure 4:
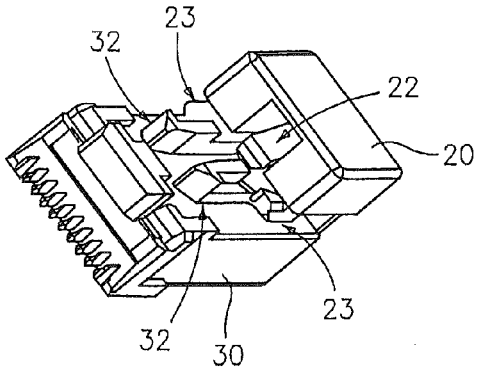
FIG. 4 is a perspective view of a boot cap on the plug body in embodiments of the invention.

FIG. 4 is a perspective view of a boot cap 20 on the plug body 30 in embodiments of the invention. As shown in FIG. 4, cap latch 22 is positioned between plug latches 32. Arms 23 are positioned on the outside surfaces of plug latches 32. The cap latch 22 prevents the plug latches 32 from moving towards each other resulting in the plug being disengaged from an outlet.

FIG. 5 is a top cross-sectional view of a plug body 30 and boot cap 20 in embodiments of the invention. The distal end 24 of cap latch 22 is positioned between plug latches 32. As noted above, this prevents the boot cap 20 and boot 10 from sliding away from plug body 30 and defeating latches 32. As described in further detail below, when the cap latch 22 is disengaged, boot cap 20 can slide backwards away from the nose of plug body 30 and outlet 90. Camming surfaces 29 on arms 23 ride over tapered surfaces on latches 32 driving the latches 32 together.

Referring to FIG. 1, the boot cap 20 includes an opening 28 on a rear wall of the boot cap 20. Opening 28 receives key 40 that deflects the cap latch 22 moving the cap latch 22 up and out from in-between plug latches 32 allowing the boot cap 20 and boot 10 to slide backwards and deflect plug latches 32 inward. In operation, key 40 is used to deflect cap latch 22 upwards so boot cap 20 and boot 10 can slide backwards, defeating latches 32. Once the plug is mated with an outlet 90, the boot 10 and boot cap 20 are slid forward so that latches 32 resume their rest position and engage the outlet. Once engaged, the key 40 is removed causing the cap latch 22 to deflect downward as it is resiliently biased in this position. The distal end 24 of cap latch 22 wedges between the plug latches 32 preventing movement of the boot cap 20 and boot 10. Without key 40, the cap latch 22 stays in position preventing inadvertent or deliberate attempts to unplug plug body 30.

Figure 6:
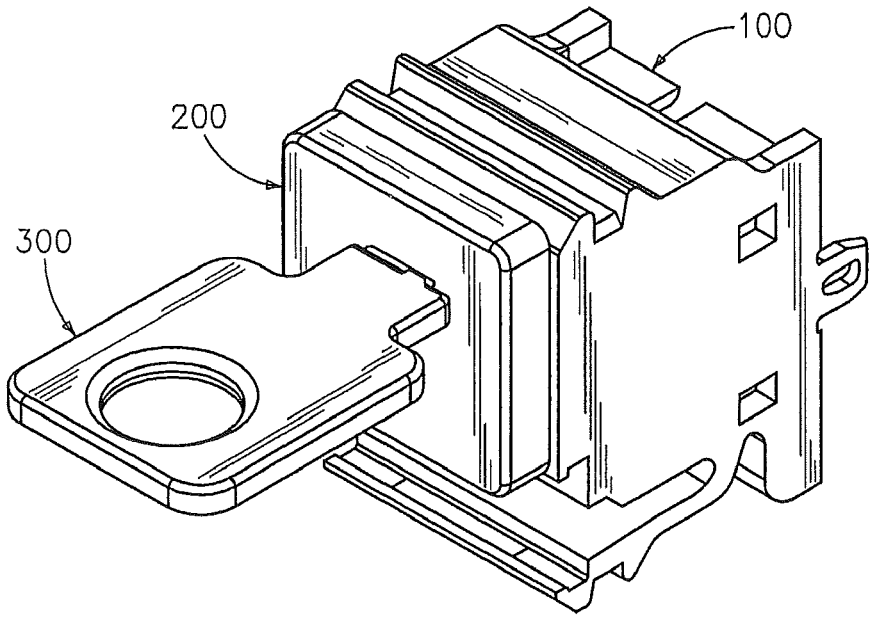
FIG. 6 is a perspective view of an outlet fitted with an outlet cap and a key in embodiments of the invention.

FIG. 6 is a perspective view of an outlet 100 fitted with an outlet locking apparatus having an outlet cap 200 and a key 300 in embodiments of the invention. The outlet cap 200 prevents access to the outlet 100 until unlocked and removed with the key 300. Key 300 and key 40 (FIG. 1) may be the same key.

Figure 7:
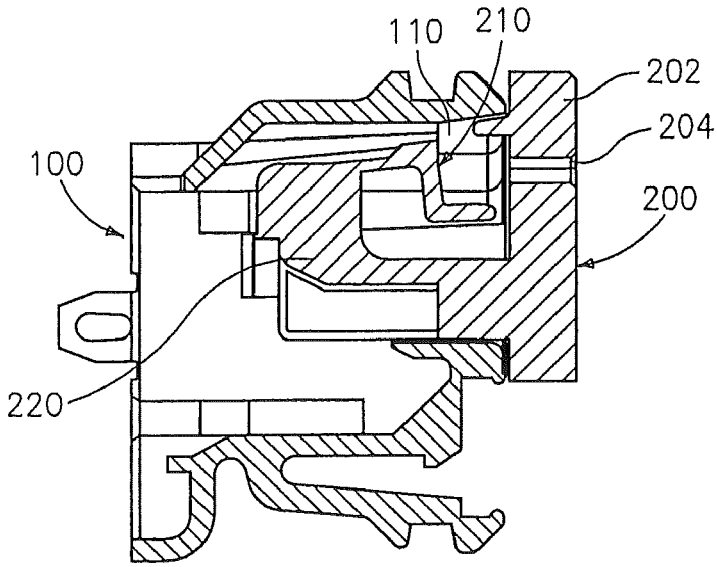
FIG. 7 is a cross-sectional view of an outlet cap mounted on the outlet in embodiments of the invention.

FIG. 7 is a cross-sectional view of an outlet cap 200 mounted on the outlet 100 in embodiments of the invention. Outlet cap 200 includes a front face 202 that covers the opening to the outlet 100. An opening 204 is formed through the outlet cap 200 to allow key 300 to enter the opening and disengage a latch 210. Latch 210 is supported by body portion 220 which is a structural portion joined to face 202 that enters the outlet and supports face 202 and latch 210. The body portion 220 is sized to fit in the interior of the telecommunications outlet 100. Latch 210 is resilient and is deflected up and down as described herein.

When the outlet cap 200 is pushed into outlet 100, the latch 210 engages front wall 110 of outlet 100, deflecting the latch downwards. Once the latch 210 clears the front wall 110, latch 210 springs back upwards and is positioned behind front wall 110 thereby preventing removal of the cap 200 without defeating latch 210.

Figure 8:
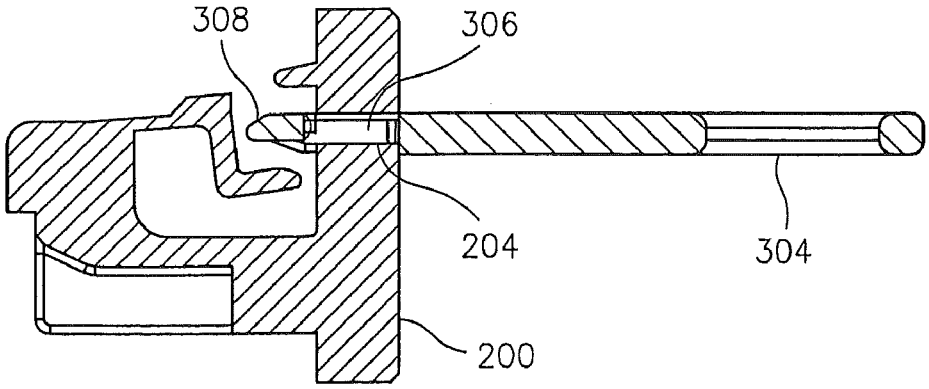
FIG. 8 is a cross-sectional view of an outlet cap and key in embodiments of the invention

FIG. 8 is a cross-sectional view of outlet cap 200 and key 300 in embodiments of the invention. Key 300 has a handle 304 with a stem 306 attached thereto. A key tooth 308 extends from the stem. The handle 304, stem 306 and tooth 308 lie in a common plane. The tooth 308 and stem 306 are sized to fit in the opening 204 in face 202. The stem 306 is sized to be able to rotate within opening 204. When key 300 is inserted in opening 204, tooth 308 is positioned above latch 210. When key 300 is rotated, tooth 308 rotates downwards and deflects latch 210 downwards so that latch 210 clears front wall 110. This allows the outlet cap 200 to be removed from the outlet 100.

Figure 9:
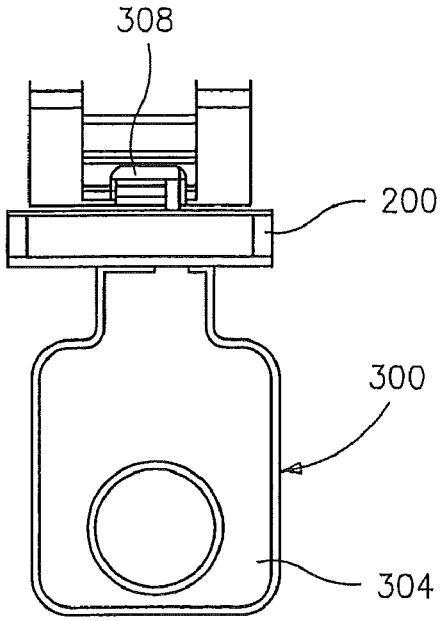
FIG. 9 is a top view of an outlet cap and key in embodiments of the invention

FIG. 9 is a top view of the outlet cap 200 and key 300 in embodiments of the invention.

Keys 40 and 300 may be the same key and may have a number of versions, each having different shaped tooth 308. The openings 28 and 204 may be shaped to receive one type of key. Further, the key 300, boot cap 20 and outlet cap 200 may be color coded to immediately indicate which key 300 functions with which boot cap 20 and outlet cap 200. For example, a key having a first color will only work with a boot cap 20 and an outlet cap 200 having the same color.

Embodiments of the invention have been described with reference to an RJ45 plug and outlet. It is understood that other electrical plug formats may be used and the invention is not limited to RJ45 plugs and outlets. Thus, the terms plug and outlet are intended to cover a variety of transmission media (copper, fiber, coax) and a variety of connector formats.

While the invention has been described with reference to exemplary embodiments, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiments disclosed for carrying out this invention.

What is claimed is:

1. A telecommunications plug comprising:

a plug body;

plug latches mounted on the plug body, the plug latches being movable between a latched and unlatched state;

a boot cap having arms extending therefrom, each arm including a camming surface engaging an outside surface of one of the plug latches, wherein moving the boot cap in a first direction drives the plug latches towards each other;

a cap latch mounted to the boot cap, the cap latch having a resilient arm extended downwardly and including a distal end positioned between the plug latches preventing movement of the boot cap in the first direction;

wherein the boot cap includes an opening for receiving a key to deflect the cap latch allowing movement of the boot cap in the first direction; and wherein the cap latch is resiliently biased towards the plug body.

2. The telecommunications plug of claim 1 further comprising:

a boot secured to the boot cap.

3. The telecommunications plug of claim 1 wherein:

the outside surfaces of the plug latches are tapered to coact with the camming surfaces.

* * * * *